US007783224B2

(12) United States Patent
Kwon

(10) Patent No.: US 7,783,224 B2
(45) Date of Patent: Aug. 24, 2010

(54) IMAGE FORMING APPARATUS TO ADJUST A SUPPLIED CHARGE TO IMPROVE PRINTING QUALITY AND IMAGE FORMING METHOD THEREOF

(75) Inventor: Tai-eun Kwon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/865,968

(22) Filed: Oct. 2, 2007

(65) Prior Publication Data

US 2008/0187348 A1 Aug. 7, 2008

(30) Foreign Application Priority Data

Feb. 2, 2007 (KR) ..... 10-2007-0011072

(51) Int. Cl.
*G03G 15/00* (2006.01)

(52) U.S. Cl. ..... 399/89; 399/50

(58) Field of Classification Search ..... 399/89, 399/50, 38, 66

See application file for complete search history.

(56) References Cited

U.S. PATENT DOCUMENTS 5,164,779 A * 11/1992 Araya et al. ..... 399/176
5,479,243 A * 12/1995 Kurokawa et al. ..... 399/159
5,517,289 A * 5/1996 Ito et al. ..... 399/149
5,541,717 A * 7/1996 Saito et al. ..... 399/150
5,839,026 A * 11/1998 Ko ..... 399/100
5,845,172 A * 12/1998 Saito et al. ..... 399/50
6,965,742 B2 * 11/2005 Miyamoto et al. ..... 399/50
7,184,678 B2 * 2/2007 Ishii et al. ..... 399/66
2003/0228166 A1 * 12/2003 Nakagawa et al. ..... 399/66

FOREIGN PATENT DOCUMENTS

| | | |
|---|---|---|
| JP | 11-184281 | 7/1999 |
| JP | 2000-242098 | 9/2000 |
| JP | 2000-330400 | 11/2000 |
| JP | 2001-27854 | 1/2001 |
| JP | 2003-307886 | 10/2003 |
| KR | 2004-70837 | 8/2004 |
| KR | 2005-32761 | 4/2005 |
| WO | 2005/108253 | 11/2005 |

OTHER PUBLICATIONS

Computer Translation JP2005-027854A.*

* cited by examiner

*Primary Examiner*—Quana M Grainger
(74) *Attorney, Agent, or Firm*—Stanzione & Kim, LLP

(57) ABSTRACT

An image forming apparatus includes a photosensitive body to be developed by a conductive toner, a charger which charges a surface of the photosensitive body with a surface potential, a power supply which supplies one of a normal charging power to perform a normal charging operation and a compensation charging power, having a different absolute value than the normal charging power and having the same polarity as the normal charging power, to the charger, and a controller which controls the power supply to supply the normal charging power and the compensation charging power to the charger, respectively, before and after a charging time at which a rear end contact surface of the photosensitive body contacting a rear end of a printing medium is charged by the charger.

17 Claims, 10 Drawing Sheets

IMAGE FORMING APPARATUS TO ADJUST A SUPPLIED CHARGE TO IMPROVE PRINTING QUALITY AND IMAGE FORMING METHOD THEREOF

CROSS-REFERENCE TO RELATED APPLICATIONS

This application claims priority under 35 U.S.C. §119(a) from Korean Patent Application No. 10-2007-0011072, filed on Feb. 2, 2007, in the Korean Intellectual Property Office, the disclosure of which is incorporated herein in its entirety by reference.

BACKGROUND OF THE INVENTION

1. Field of the Invention

The present general inventive concept relates to an image forming apparatus and an image forming method thereof, and more particularly, to an image forming apparatus which improves a printing quality, and an image forming method thereof.

2. Description of the Related Art

An electrophotograhic image forming apparatus forms an image on a printing medium through charging, exposing, developing, transferring and fixing processes. The electrophotograhic image forming apparatus includes a laser printer, a photocopier, a multifunction printer, etc.

As illustrated in FIGS. 1A and 1B, a conventional electrophotograhic image forming apparatus 1 includes a supplying roller 10, a developing roller 20, a charging roller 30, a photosensitive drum 40, a transfer roller 50, and a moving roller 60. The electrophotograhic image forming apparatus 1 further includes an exposing unit (not illustrated) which exposes a surface of the photosensitive drum 40 to light L.

The charging roller 30 receives approximately −1,400 Vdc from a high voltage power supply (HVPS) which is provided in the image forming apparatus 1 and supplies a high voltage, and contacts and charges the photosensitive drum 40 to provide a surface potential of about −800 Vdc. The surface of the photosensitive drum 40 is exposed to light corresponding to image information by the exposing unit, thereby forming an electrostatic latent image thereon. An exposing region of the latent image has an electric potential of approximately −50 Vdc, which is higher than a non-exposing region of −800 Vdc.

The supplying roller 10 supplies a toner accommodated in a toner accommodator (not illustrated) to the developing roller 20, and frictionally charges the toner with a negative charge. A thickness of the toner supplied to the developing roller 20 is controlled by a regulating blade 3. The developing roller 20 develops the electrostatic latent image formed on the surface of the photosensitive drum 40 with the toner. Then, a visible toner image including the toner is formed on the surface of the photosensitive drum 40.

The HVPS supplies a high voltage, i.e., approximate +1,200 Vdc and having an opposite polarity to the negative charge of the toner, to the transfer roller 50. The visible toner image is transferred to a printing medium P1 which passes a transfer region A formed between the photosensitive drum 40 and the transfer roller 50. The toner which remains in the surface of the photosensitive drum 40 is stacked in a cleaning film 5. A part of the remaining toner passes the cleaning film 5 and is retrieved to the developing roller 20 by a nip between the photosensitive drum 40 and the developing roller 20.

The visible toner image which is transferred to the printing medium P1 is fixed thereto by heat and pressure, thereby completing a printing process.

About 2,000 Vdc potential difference exists between the photosensitive drum 40 and the transfer roller 50. Thus, if the printing medium P1 passes a transfer region A, the printing medium P1 has an induced charge. As illustrated in FIG. 1B, the printing medium P1 is charged with a positive charge by the transfer roller 50. The moment the printing medium P1 is separated from the photosensitive drum 40, the positive charge of the printing medium P1 is introduced to a rear end contact surface C of the photosensitive drum 40 contacting an end part of the printing medium P1. As illustrated in FIG. 1C, the rear end contact surface C has a higher electric potential than the nearby surface potential of −800 Vdc in a lengthwise direction. The potential difference between the rear end contact surface C and the photosensitive drum 40 having −800V surface potential is continuously maintained to cause poor picture quality.

As the photosensitive drum 40 rotates, the remaining toner T having the negative charge and being stacked in the cleaning film 5 contacts the rear end contact surface C having a relatively smaller electric repulsion than the −800 Vdc surface potential of the photosensitive drum 40. Then, a line image appears in a subsequent printing medium P2 in a transverse direction with respect to a paper-feeding direction, thereby lowering printing quality.

SUMMARY OF THE INVENTION

The present general inventive concept provides an image forming apparatus which improves a printing quality, and an image forming method thereof.

Additional aspects and/or utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus, including a photosensitive body to be developed by a conductive toner, a charger which charges a surface of the photosensitive body with a surface potential, a power supply which supplies one of a normal charging power to perform a normal charging operation and a compensation charging power having a different absolute value than the normal charging power and having the same polarity as the normal charging power, to the charger, and a controller which controls the power supply to supply the normal charging power and the compensation charging power to the charger, respectively, before and after a charging time at which a rear end contact surface of the photosensitive body contacting a rear end of a printing medium is charged by the charger.

The compensation charging power may have a larger absolute value than the normal charging power The image forming apparatus further may include a charging time counter which counts the charging time.

The image forming apparatus further may include a medium moving part which moves the printing medium to the photosensitive body, and a first medium detector provided on a printing medium moving path before the printing medium passes the photosensitive body to detect a position of the printing medium, wherein the charging time counter counts the charging time based on a detection signal of the first medium detector and a moving speed of the printing medium.

The controller may control the power supply to supply the normal charging power to the charger again after a time passes from the charging time.

The image forming apparatus further may include a transfer part which faces the photosensitive body, with the printing medium to be printed being interposed therebetween, and a medium moving part which moves the printing medium to a transfer region formed between the photosensitive body and the transfer part, wherein the power supply supplies one of a normal transfer power to form a printing potential difference to the photosensitive body and perform a normal printing operation, and a separation power to form a potential difference lower than the printing potential difference, to the transfer part, and the controller controls the power supply to supply the normal transfer power and the separation power to the transfer part, respectively, before and after a non-printing section reaching time at which the rear non-printing section of the printing medium reaches the transfer region.

The image forming apparatus further may include a reaching time estimator which counts the non-printing section reaching time.

The image forming apparatus further may include a first medium detector provided on a printing medium moving path before the printing medium passes the transfer region to detect a position of the printing medium, wherein the reaching time estimator counts the non-printing section reaching time based on a detection signal of the first medium detector and a moving speed of the printing medium.

The reaching time estimator may count a separation time at which the rear non-printing section of the printing medium is separated from the transfer region.

The controller may control the power supply to supply the separation power to the transfer part from the non-printing section reaching time to the separation time, and to supply the normal transfer power to the transfer part before the non-printing section reaching time and after the separation time.

The image forming apparatus further may include a second medium detector which is spaced from the transfer region as much as the rear non-printing section of the printing medium on the printing medium moving path before the printing medium passes the transfer region and detects a position of the printing medium, wherein the controller controls the power supply to supply one of the normal transfer power and the separation power to the transfer part according to the detection signal of the second medium detector.

The separation power may correspond to the surface potential.

The foregoing and/or other aspects and utilities of the present general inventive concept can also be achieved by providing an image forming method of an image forming apparatus which includes a photosensitive body to be developed by a conductive toner, a charger charging a surface of the photosensitive body in a surface potential, and a transfer part facing the photosensitive body, with a printing medium to be printed being interposed therebetween, the method including moving the printing medium to a transfer region, determining whether a current time is before or after a charging time at which a rear end contact surface of the photosensitive body contacting a rear end of the printing medium is charged by the charger, supplying a normal charging power to the charger to perform a normal charging operation if the current time is before the charging time, and supplying a compensation charging power having a different absolute value than the normal charging power and having the same polarity as the normal charging power, to the charger if the current time is after the charging time.

The compensation charging power may have a larger absolute value than the normal charging power.

The method further may include estimating the charging time.

The image forming apparatus further may include a first medium detector provided on a printing medium moving path before the printing medium passes the transfer region to detect a position of the printing medium, wherein the estimating the charging time includes estimating the charging time based on a detection signal of the first medium detector and a moving speed of the printing medium.

The method further may include supplying the normal charging power to the charger after a time passes from the charging time.

The method further may include determining whether the current time is before or after a non-printing section reaching time at which the rear non-printing section of the printing medium reaches the transfer region, supplying a normal transfer power to the transfer part to form a printing potential difference to the photosensitive body and perform a normal printing operation if the current time is before the non-printing section reaching time, and supplying a separation power to the transfer part to form a potential difference lower than the printing potential difference if the current time is after the non-printing section reaching time.

The method further may include estimating the non-printing section reaching time.

The image forming apparatus may include a first medium detector provided on a printing medium moving path before the printing medium passes the transfer region to detect a position of the printing medium, and wherein the non-printing section reaching time is counted based on a detection signal of the first medium detector and a moving speed of the printing medium.

The method further may include estimating separation time at which the rear non-printing section of the printing medium is separated from the transfer region, and supplying the separation power to the transfer part until the separation time.

The method further may include supplying the normal transfer power to the transfer part after the separation time passes.

The foregoing and/or other aspects and utilities of the present general inventive concept can also be achieved by providing an image forming apparatus, including a photosensitive body to be developed by a toner, and a charger which charges a surface of the photosensitive body with a surface potential, the surface potential corresponding to each of a normal surface potential to perform a normal printing operation and a separation surface potential lower than the normal surface potential.

The foregoing and/or other aspects and utilities of the present general inventive concept can also be achieved by providing an image forming apparatus, including a photosensitive body to be developed by a toner, and a controller to control supply of a normal charge to charge the photosensitive body to a surface potential to perform a normal printing operation on a printing medium, to control supply of a separation charge to lower the potential difference between a transfer part and the photosensitive body when a non-printing area of the printing medium is fed between the photosensitive body and the transfer body, and to control supply of a compensation charge to restore the surface potential when the printing medium exits from between the photosensitive body and the transfer body.

The foregoing and/or other aspects and utilities of the present general inventive concept can also be achieved by providing an image forming apparatus, including a photosensitive body to form a latent electrostatic image to be developed by a toner, a developer supply part to supply toner to the photosensitive body, a transfer body disposed facing the photosensitive body to transfer the developed latent electrostatic image to a printing medium fed therebetween, a charger to charge a surface of the photosensitive body to a predetermined surface potential, a power supply to supply at least a normal charge, a separation charge, and a compensation charge to the charger, and a controller to control the power supply to supply at least two of the normal charge, the separation charge, and the compensation charge to the charger, wherein the controller controls the power supply to supply the normal charge to charge the photosensitive body to the predetermined surface potential to perform a normal printing operation on the printing medium, supply the separation charge to lower the potential difference between the transfer part and the photosensitive body when a non-printing area of the printing medium is fed between the photosensitive body and the transfer body, and supply the compensation charge to restore the predetermined surface potential when the printing medium exits from between the photosensitive body and the transfer body.

The compensation charge may have a larger absolute value than the normal charge and may have a same polarity as the normal charge.

A rear end contact surface of the photosensitive body may contact a rear end of the printing medium when the printing medium exits from between the photosensitive body and the transfer body.

The image forming apparatus may further include at least one of a charging time counter and a reaching time estimator to define a first charge period, a second charge period, and a third charge period with respect to a feeding position of the printing medium, wherein the controller controls the power supply to supply the normal charge, the separation charge, and the compensation charge to the charger according to the first, second, and third charge periods, respectively.

The first charge period may correspond to a time t1 for a normal printing operation defined as a predetermined time after the printing medium passes a first medium detector to a time a printing portion of the printing medium is fed between the photosensitive body and the transfer part, the second charge period may correspond to a time t2 for a non-printing area of the printing medium to be fed between the photosensitive body and the transfer part, and the third charge period may correspond to a time t3 after the non-printing area of the printing medium exits between the photosensitive body and the transfer part.

The foregoing and/or other aspects and utilities of the present general inventive concept can also be achieved by providing an image forming method for an image forming device having a photosensitive body and a charger, the method including supplying a first charge to the photosensitive body from the charger to charge the photosensitive body to a surface potential to perform a normal printing operation on a printing medium, and supplying a second charge to the photosensitive body from the charger to restore the surface potential when the printing medium exits from between the photosensitive body and the transfer body, to prepare normal printing of a subsequent printing medium.

The foregoing and/or other aspects and utilities of the present general inventive concept can also be achieved by providing an image forming method for an image forming device having a photosensitive body and a charger, the method including supplying the photosensitive body with different charges corresponding to one of a normal printing operation of a printing medium, and a compensation operation to prepare for a normal printing operation of a subsequent printing medium.

BRIEF DESCRIPTION OF THE DRAWINGS

These and/or other aspects and utilities of the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1A:
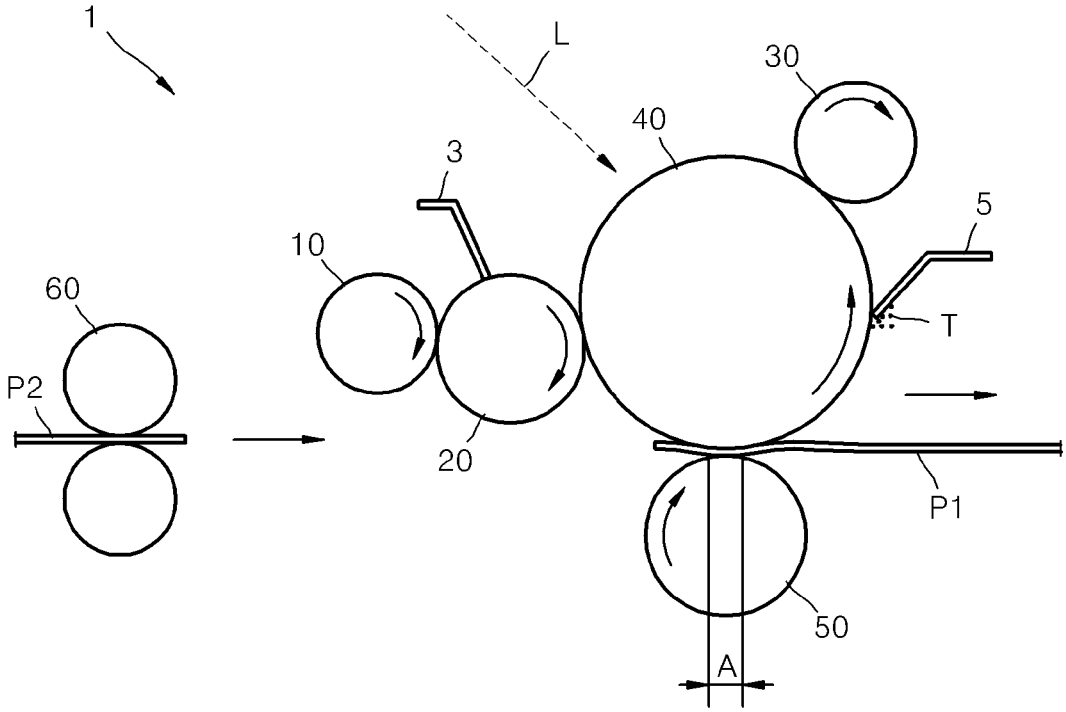
FIG. 1A (PRIOR ART)
FIGS. 1A and 1B illustrate a transfer process of a conventional image forming apparatus.
Figure 1B:
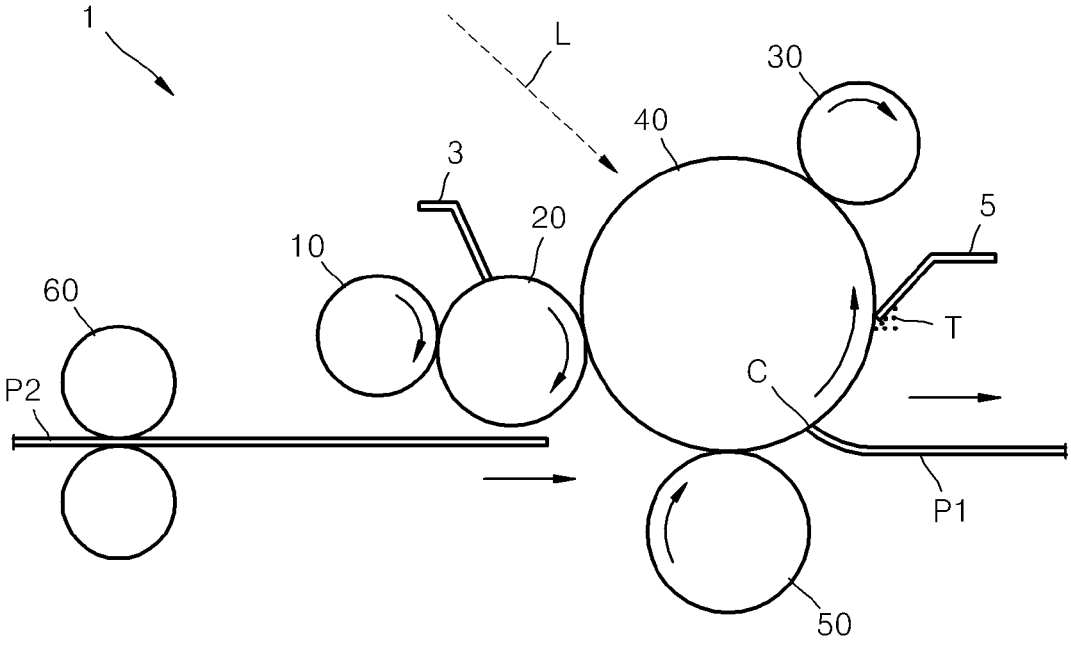
FIG. 1B (PRIOR ART)
Figure 1C:
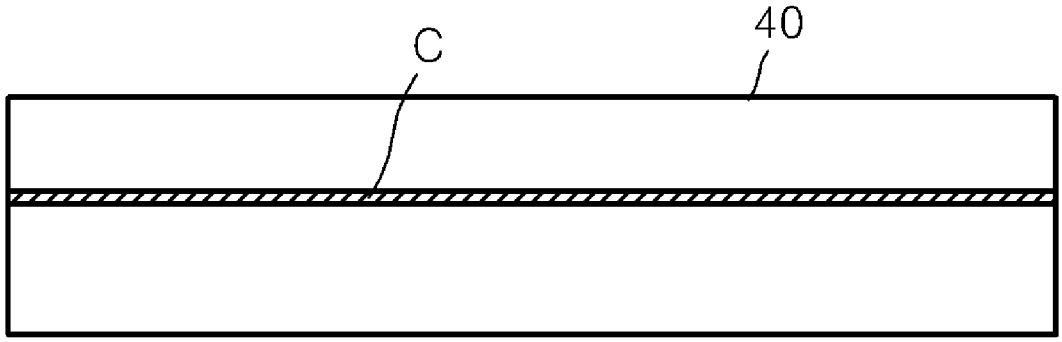
FIG. 1C (PRIOR ART)
FIG. 1C is a schematic plan view of a photosensitive drum of the conventional image forming apparatus in FIG. 1B.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2A:
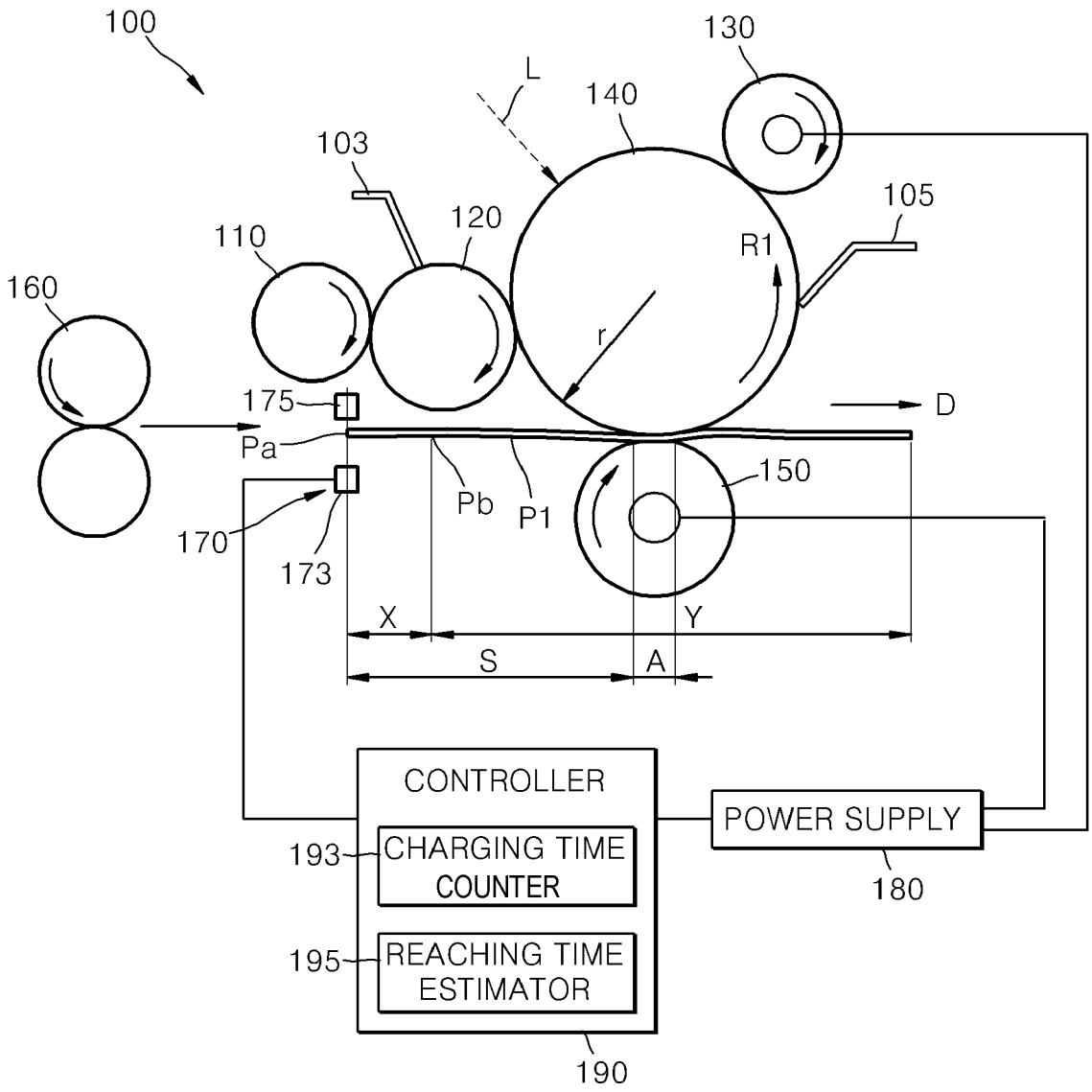
FIGS. 2A to 2C are schematic views of an image forming apparatus which moves a printing medium, according to an exemplary embodiment of the present general inventive concept.
Figure 2B:
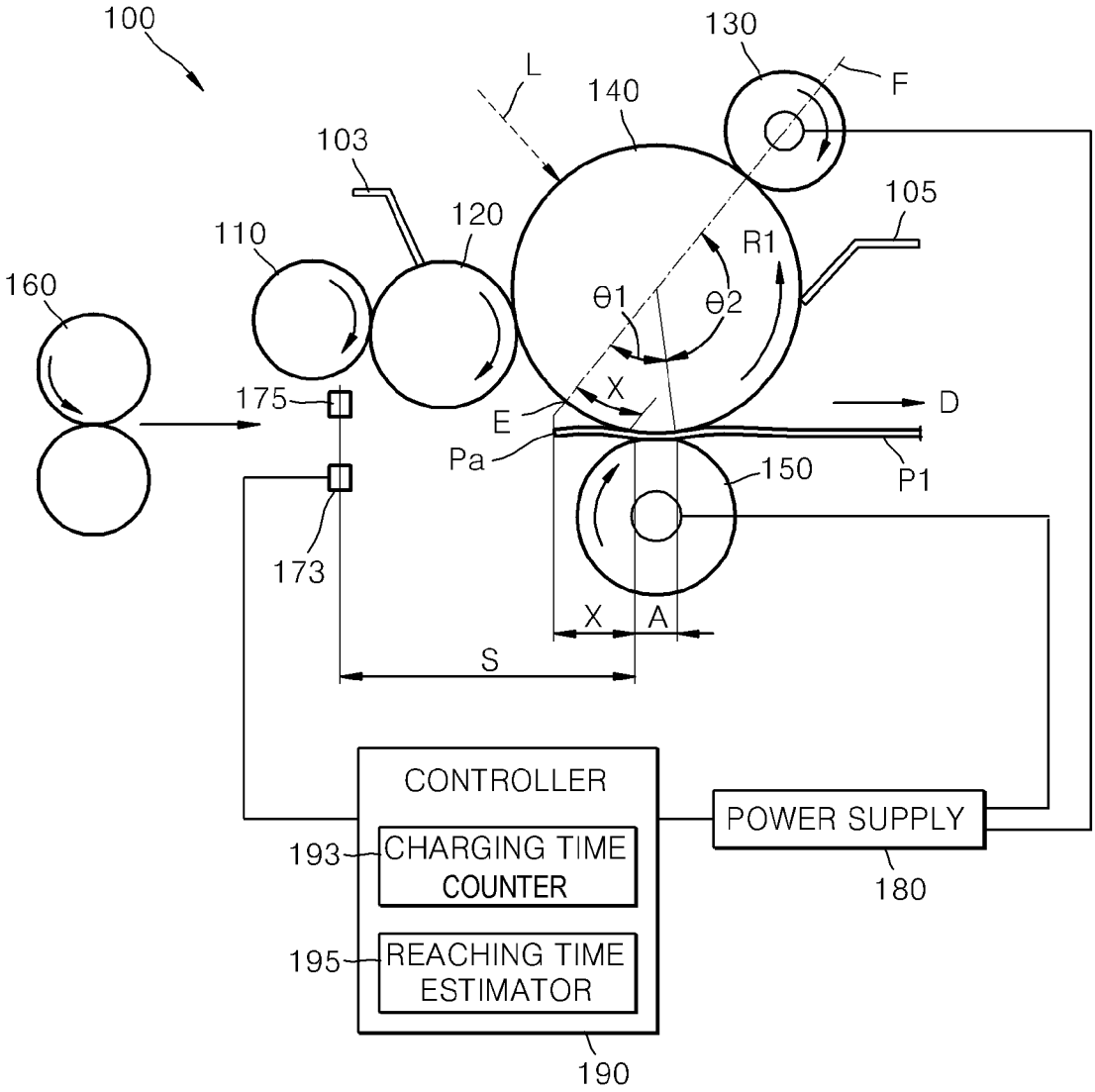
Figure 2C:
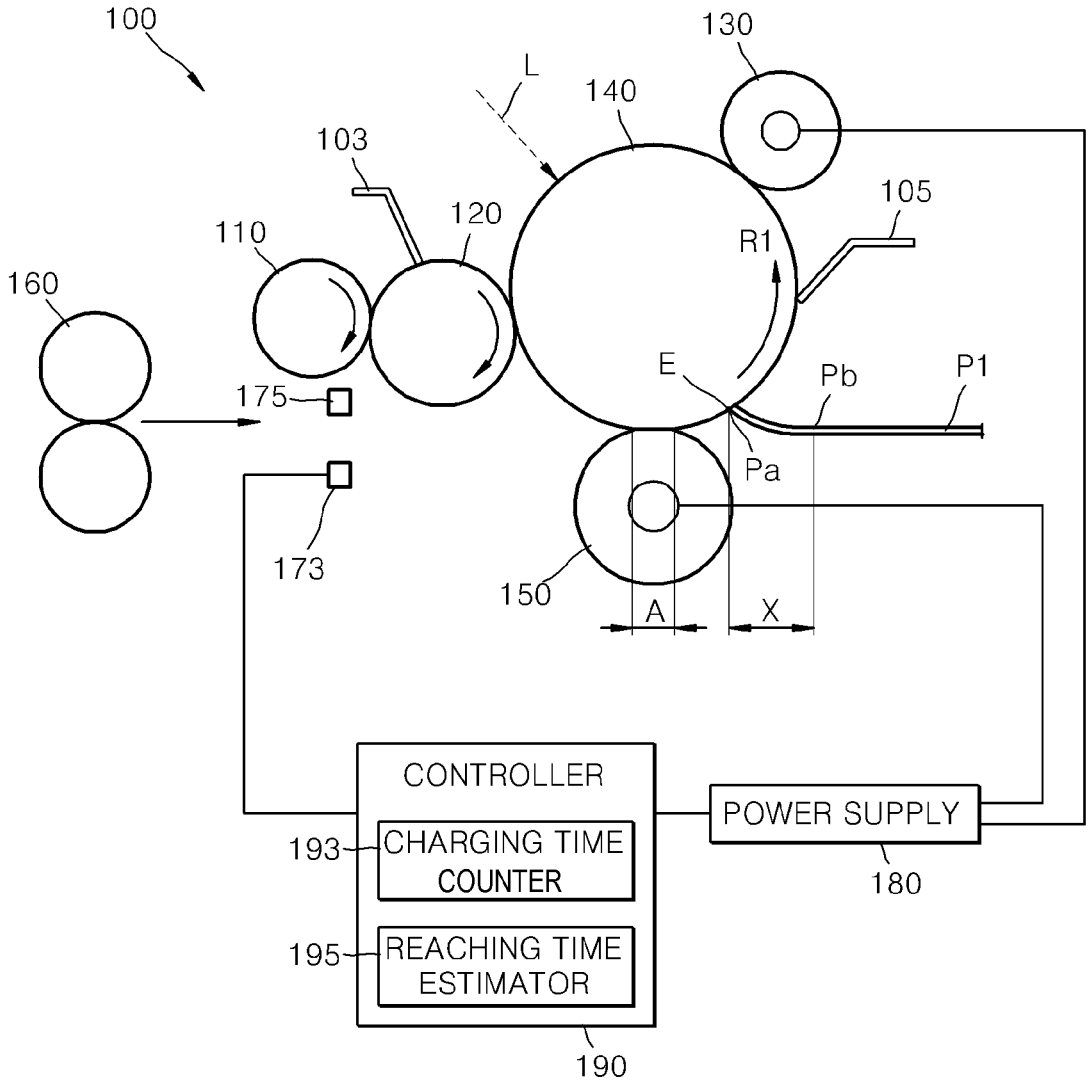

FIG. 2A illustrates an image forming apparatus 100 right after a rear end Pa of a printing medium P1 passes a first medium detector 170. FIG. 2B illustrate the image forming apparatus 100 when the printing medium P1 in FIG. 2A has moved in a paper-feeding direction and a start point Pb of a non-printing section X of the printing medium P1 in FIG. 2B starts to pass a transfer region A. FIG. 2C illustrate the image forming apparatus 100 when the rear end Pa of the printing medium P1 starts to leave the transfer region A and move away from a photosensitive body 140.

The printing medium P1 has a printing section Y and a non-printing section X in a moving direction D. The non-printing section is not formed an image, i.e., corresponds to a normal margin. The printing medium P1 can also have a top non-printing section (not illustrated) and a rear non-printing section X with respect to the moving direction D.

As illustrated in FIGS. 2A to 2C, the image forming apparatus 100 according to an exemplary embodiment of the present general inventive concept may include a supplying roller 110, a developing roller 120, a charger 130, a photosensitive body 140, a transfer part 150, a medium moving part 160, the first medium detector 170, a power supply 180, and a controller 190.

The supplying roller 110 can receive a toner from a toner accommodator (not illustrated), and supplies it to the developing roller 120. The supplying roller 110 can frictionally charge the toner with a negative charge by rotating in the same direction as the developing roller 120. The charged toner is attached to an external surface of the developing roller 120.

The thickness of the toner can be controlled by a regulating blade 103. The developing roller 120 can develop an electrostatic latent image of the photosensitive body 140 with the toner having the controlled thickness, and can form a visible toner image on the photosensitive body 140.

The charger 130 can receive power in a same polarity as an electric charge of the toner, and can charge a surface of the photosensitive body 140 to a predetermined surface potential. Thus, the surface potential of the photosensitive body 140 can have the same polarity as the electric charge of the toner. As illustrated in FIG. 2A, the charger 130 may include a charging roller to contact and charge the photosensitive body 140. The charger 130 may include a corona charger which does not contact the photosensitive body 140, as necessary.

As illustrated in FIG. 2A, the photosensitive body 140 may include a photosensitive drum, or a belt as necessary. The photosensitive body 140 is charged with the surface potential, and the surface thereof is exposed to light corresponding to image information by an exposing unit (not illustrated) to form the electrostatic latent image.

The transfer part 150 faces the photosensitive body 140, leaving the printing medium P1 to be printed therebetween, and transfers the visible toner image to the printing medium P1. The transfer part 150 can receive a power having an opposite polarity to the electric charge of the toner, from the power supply 180. Thus, the transfer part 150 may transfer the visible toner image to the printing medium P1 through an electric attraction.

As illustrated in FIG. 2A, the transfer part 150 may include a transfer roller, or a belt as necessary.

The photosensitive body 140 and the transfer part 150 face each other and form the transfer region A in which the visible toner image is transferred to the printing medium P1. The transfer region A may include a transfer nip.

The medium moving part 160 may include a pair of rollers to move the printing medium P1 to the transfer region A between the photosensitive body 140 and the transfer part 150.

The power supply 180 may supply a normal charging power to perform a normal charging operation, and a compensation charging power having a larger absolute value than the normal charging power and having a same polarity as the normal charging power, to the charger 130. The power supply 180 may supply one of a voltage power and a current power to the charger 130.

The normal charging power is supplied to charge the surface of the photosensitive body 140 with the surface potential described above. For example, the normal charging power may be −1,400V which can be supplied to the charging roller 130 of the image forming apparatus 100. Then, the surface potential of the photosensitive body 140 becomes −800V. The normal charging power may be properly set in consideration of the surface potential of the photosensitive body 140.

For example, if the normal charging power is set as −1,400V, the compensation charging power may be set as −1,500V, which has the same polarity as the normal charging power and has a larger absolute value. Alternatively, the compensation charging power may be properly set to compensate for the potential loss due to the electric charge introduced to the surface of the photosensitive body 140 when the printing medium P1 is separated from the photosensitive body 140.

The power supply 180 supplies one of normal transfer power to form a printing potential difference to perform a normal printing operation with respect to the photosensitive body 140, and separation power to form a potential difference lower than the printing potential difference, to the transfer part 150.

That is, if the surface potential of the photosensitive body 140 is −800V, and if the normal transfer power is +1,200V, the printing potential difference between the photosensitive body 140 and the transfer part 150 is approximately 2,000V. The separation power may range from −800 Vdc to +1,200V to have a lower potential difference than the printing potential difference of +2000 Vdc.

The separation power may be set corresponding to the surface potential so that the separation transfer potential formed on the surface of the transfer part 150 is equal to the surface potential of the photosensitive body 140 when the separation power is supplied to the transfer part 150. If the separation transfer potential is equal to the surface potential of the photosensitive body 140, electrostatic induction does not occur in the printing medium P1 which passes the transfer region A.

The first medium detector 170 may include a light receiver 173 and a light emitter 175. The light receiver 173 and the light emitter 175 can be vertically provided with the moving path of the printing medium P1 being interposed therebetween. While the printing medium P1 passes the first medium detector 170, the printing medium P1 blocks light emitted by the light emitter 175 so that the light receiver 173 does not receive light. Alternatively, the first medium detector 170 may include a contact sensor as long as it detects whether the printing medium P1 passes or not.

As illustrated in FIG. 2A, the controller 190 may include a charging time counter 193 which counts charging time at which one of the normal charging power and the compensation charging power is supplied to the charger 130.

The controller 190 may include a reaching time estimator 195 to count non-printing section reaching time at which one of the normal transfer power and the separation power is supplied to the transfer part 150.

Hereinafter, a method of estimating the non-printing section reaching time will be described. As illustrated in FIG. 2B, a non-printing section reaching time t2 refers to a time at which the rear non-printing section X of the printing medium P1 reaches the transfer region A. More specifically, the non-printing section reaching time t2 refers to time at which the start point Pb of the rear non-printing section X starts passing the transfer region A.

As illustrated in FIG. 2A, t1 is a sensor passing time of the printing medium P1 right after passing the first medium detector 170. In this case, the non-printing section reaching time t2 satisfies the following Formula 1.

$$t2 - t1 = \frac{S - X}{Vm} = \Delta Ta \qquad \text{[Formula 1]}$$

Here, the sensor passing time t1 is known by a signal from the first medium detector 170. A distance S between the first medium detector 170 and the transfer region A is a design value to be a known value. The rear non-printing section X is a margin of the printing medium P1 and is also a known value. The printing medium moving speed Vm may be calculated, for example, with Formula 2 below by using a number of rotation R1 (rpm) of the photosensitive body 140 and a radius r of the photosensitive body 140.

$$Vm = R1\frac{\pi}{30} \times r(\text{m/sec}) \qquad \text{[Formula 2]}$$

The non-printing section reaching time t2 may be counted by Formulas 1 and 2.

Meanwhile, the reaching time estimator 195 may count a separation time t3 at which a rear end Pa of the printing medium P1 is separated from the transfer region A, as the following Formula 3.

$$t3 - t2 = \frac{X + A}{Vm} = 30\frac{X + A}{\pi rR1} = \Delta Tb \quad \text{[Formula 3]}$$

The separation time t3 is a reference time at which the power supplied to the transfer part 150 is switched from the separation power to the normal transfer power. As illustrated in FIG. 2C, the separation time t3 may be a time at which the rear end Pa of the printing medium P1 is separated from a rear end contact surface E of the photosensitive body 140. However, it is difficult to count the separation time accurately since it may vary depending on the type of the printing medium P1 and other environmental conditions.

Thus, a predetermined margin time M (refer to FIG. 3) may be added to the separation time t3 calculated with the Formula 3 to set a switching time t4 at which the separation power is switched to the normal transfer power.

The margin time M may be zero as necessary. Alternatively, the switching time t4 may be experientially and experimentally set by considering the time from the non-printing section reaching time t2 to a time when the rear non-printing section X of the printing medium P1 passes the transfer region A, instead of estimating the separation time t3.

Hereinafter, a method of estimating a charging time t5 by the charging time counter 193 will be described.

As illustrated in FIG. 2B, the rear end Pa of the printing medium P1 does not enter the transfer region A at the non-printing section reaching time t2. The relative angle Δθ(rad) between the rear end contact surface E of the photosensitive body 140 contacting the rear end Pa of the printing medium P1, and a charging position F charged by the charger 130 can be calculated by the following Formula 4.

$$\Delta\theta = \theta 1 + \theta 2 = (X + A)/r + \theta 2 \quad \text{[Formula 4]}$$

Here, a circumference of the photosensitive body 140 corresponding to the angle θ1 is approximately X+A.

The charging time t5 may be counted from the relative angle Δθ by the following Formula 5.

$$t5 - t2 = \frac{\Delta\theta}{R1} \times \frac{30}{\pi} = \Delta Tc = 30\frac{(X + A + r\theta 2)}{\pi rR1} \quad \text{[Formula 5]}$$

Here, 30/pi is provided to convert rpm into rad/sec. R1 refers to the number of rotation R1 (rpm) of the photosensitive body 140. θ2 is an angle formed by a line connecting an end point of the transfer region A and the center of rotation of the photosensitive body 140, and the charging position F, which can be known at a designing stage. Also, the non-printing section X, the transfer region A, and the radius r of the photosensitive body 140 are known values. If the transfer region A is much smaller than the non-printing section X, it may be removed as necessary.

A size of the non-printing section X may be inputted by a user. For example, a user may set the non-printing section X as a margin of the printing medium P1 in an application program of a host computer (not illustrated) which is connected with the image forming apparatus 100.

Alternatively, the non-printing section X may be set as a default value regardless of a user's input. In this case, information on the non-printing section X may be stored in a memory (not illustrated) of the image forming apparatus 100 and requested or adjusted whenever it is necessary.

As described above, the charging time counter 193 and the reaching time estimator 195 count the charging time t5, the non-printing section reaching time t2, and the separation time t3 in a real time, considering that it may be necessary to calculate the times t2, t3, and t5 in a real time by sensing the number of rotation R1 of the photosensitive body 140 if the number of rotation R1 is variable.

If the number of rotation R1 of the photosensitive body 140 is set to be fixed, a time ΔTa between the non-printing section reaching time t2 and the sensor passing time t1, a time ΔTc between the charging time t5 and the non-printing section reaching time t2, and a time ΔTb between the separation time t3 and the non-printing section reaching time t2 may be set as a constant and stored in the memory (refer to Formulas 1, 2 and 3). Then, the charging time counter 193 and the reaching time estimator 195 may not need to calculate the charging time t5, the non-printing section reaching time t2, and the separation time t3 in a real time. Instead, the reaching time t2 and the charging time t5 may be calculated with the time values ΔTa and ΔTc stored in the memory. Thus, the controller 190 may not be overloaded.

Figure 3:
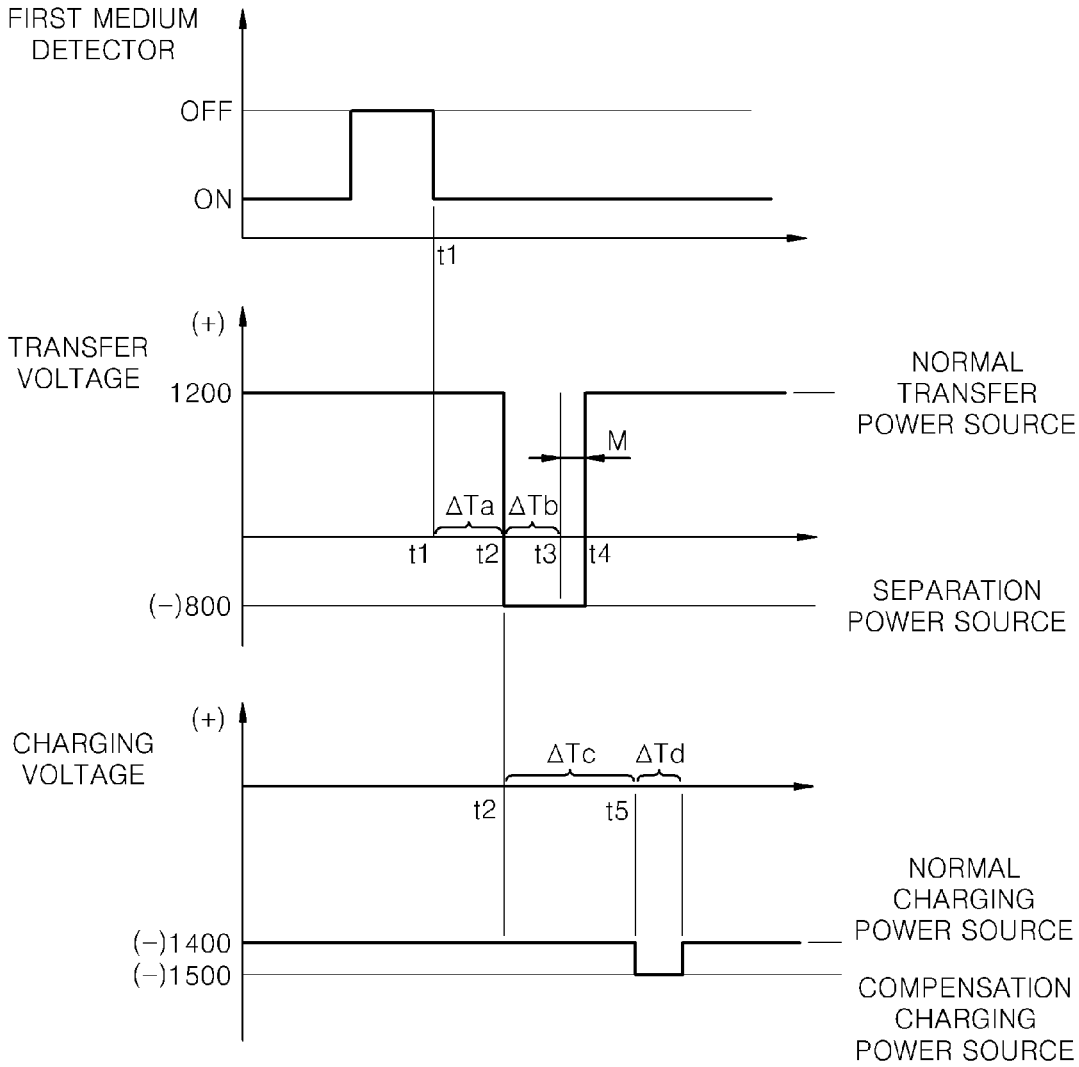
FIG. 3 illustrate graphs of a signal of a first medium detector, a transfer voltage, and a charging voltage of the image forming apparatus in FIG. 2A according to time elapsed.

FIG. 3 illustrate graphs of the charging voltage and the transfer voltage respectively supplied to the charger 130 and the transfer part 150 according to the counted non-printing section reaching time t2, the separation time t3, and the charging time t5.

As illustrated in a graph of the first medium detector 170 in FIG. 3, an ON signal can be generated when the printing medium P1 does not pass the first medium detector 170 while an OFF signal can be generated when the printing medium P1 passes the first medium detector 170. That is, the ON signal is generated when the light receiver 173 receives light while the OFF signal is generated when the light receiver 173 does not receive light.

The time when the OFF signal is switched to the ON signal can be set the sensor passing time t1 at which the rear end Pa of the printing medium P1 passes the first medium detector 170.

The controller 190 can then determine the sensor passing time t1 from an output signal of the first medium detector 170, and counts the non-printing section reaching time t2, the separation time t3, and the charging time t5 by the foregoing method.

As illustrated in a graph of the transfer voltage in FIG. 3, the controller 190 can control the power supply 180 to supply the separation power of −800V to the transfer part 150 instead of the normal transfer power of +1,200 Vdc at the non-printing section reaching time t2, by using the non-printing section reaching time t2 and the separation time t3 counted by the reaching time estimator 195. The power supply 180 supplies the normal transfer power of +1,200 Vdc to the transfer part 150 instead of the separation power −800V, based on the switching time t4 which is obtained with the separation time t3 added to the predetermined margin time M.

As illustrated in a graph of the charging voltage in FIG. 3, the controller 190 can control the power supply 180 to supply the normal charging power of −1,400 Vdc to the charger 130 before the charging time t5 counted by the charging time counter 190, and the compensation charging power of −1,500V thereto after the charging time t5. However, the present general inventive concept is not limited thereto, and the voltage value is not limited to those mentioned above, and may vary.

The compensation charging power supplying time ΔTd at which the compensation charging power is supplied to the charger 130 may be determined in consideration of the width of the rear end contact surface E when the rear end Pa of the printing medium P1 is separated from the photosensitive body 140. The controller 190 controls the power supply 180 to supply the normal charging power to the charger 130 after the compensation charging power supplying time ΔTd passes.

Hereinafter, a printing process of the image forming apparatus 100 according to an embodiment of the present general inventive concept will be described with reference to FIGS. 2A, 2B, 2C and 3.

The charger 130 receives the normal charging power of −1,400V, and charges the surface of the photosensitive body 140 with the predetermined surface potential of −800 Vdc. The surface of the photosensitive body 140 is exposed to the light L corresponding to the image information of the exposing unit (not illustrated) to form the electrostatic latent image on the photosensitive body 140.

The developing roller 120 receives the toner frictionally charged with the negative charge from the supplying roller 110 and develops the electrostatic latent image. Thus, the visible toner image is formed on the surface of the photosensitive body 140 corresponding to the image information.

The medium moving part 160 moves the printing medium P1 to the transfer region A between the photosensitive body 140 and the transfer part 150. The transfer part 150 receives the normal printing power +1,200 Vdc to perform the normal printing operation, and transfers the visible toner image to the printing medium P1 through the electric attraction.

If the printing medium P1 has passed the first medium detector 170, the controller 190 controls the charging time counter 193 and the reaching time estimator 195 to count the charging time t5, the non-printing section reaching time t2 and the separation time t3, respectively.

At the reaching time t2 at which the start point Pb of the rear non-printing section X of the printing medium P1 starts passing the transfer region A, the controller 190 controls the power supply 180 to supply the separation power of −800 Vdc to the transfer part 150. The power supply 180 supplies the separation power to the transfer part 150 until the switching time t4. Thus, if the rear non-printing section X of the printing medium P1 passes the transfer region A, the potential difference between the transfer part 150 and the photosensitive body 140 become narrower than when the normal printing operation is performed. The electric charge is less introduced to the rear end contact surface E of the photosensitive body 140. As the rear end contact surface E is not smeared with the remaining toner when passing a cleaning film 105, a line does not appear in a subsequent printing medium.

At the charging time t5, the controller 190 controls the power supply 180 to supply the compensation charging power of −1,500 Vdc to the charger 130. The compensation charging power is supplied to compensate for the electric potential of the rear end contact surface E and restore the normal surface potential of −800V. The electric potential of the rear end contact surface E is higher than the normal surface potential of −800V as the electric charge is introduced to the rear end contact surface E when the printing medium P1 is separated from the photosensitive body 140. Then, the electric potential of the rear end contact surface E is restored, thereby improving the printing quality of the subsequent printing medium.

The normal charging power is supplied again to the charger 130 after the compensation charging power supplying time ΔTd elapses, to charge the remaining surface of the photosensitive body 140 except the rear end contact surface E, with the normal surface potential of −800 Vdc.

Figure 4:
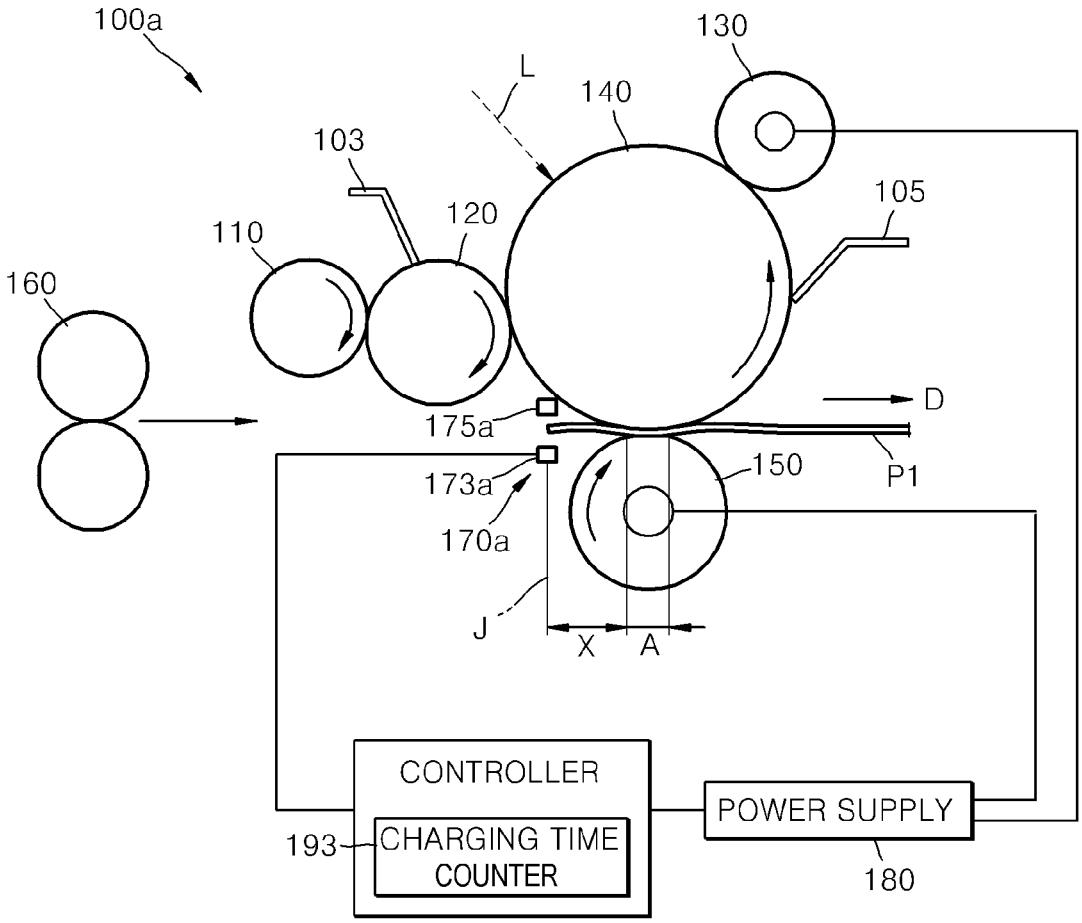
FIG. 4 is a schematic view of an image forming apparatus according to a second exemplary embodiment of the present general inventive concept.

An image forming apparatus 100*a* according to another exemplary embodiment of the present general inventive concept may include a second medium detector 170*a* instead of the first medium detector 170, as illustrated in FIG. 4. The image forming apparatus 100*a* may not include a reaching time estimator 195. Other elements of the image forming apparatus 100*a* are similar as those according to the exemplary embodiment of the present general inventive concept described above. Thus, a repeated detailed description thereof will be avoided here.

The second medium detector 170*a* is provided in a position J which is spaced from a transfer region A as much as a rear non-printing section X of a printing medium P1 on a printing medium moving path before the printing medium passes the transfer region A.

Figure 5:
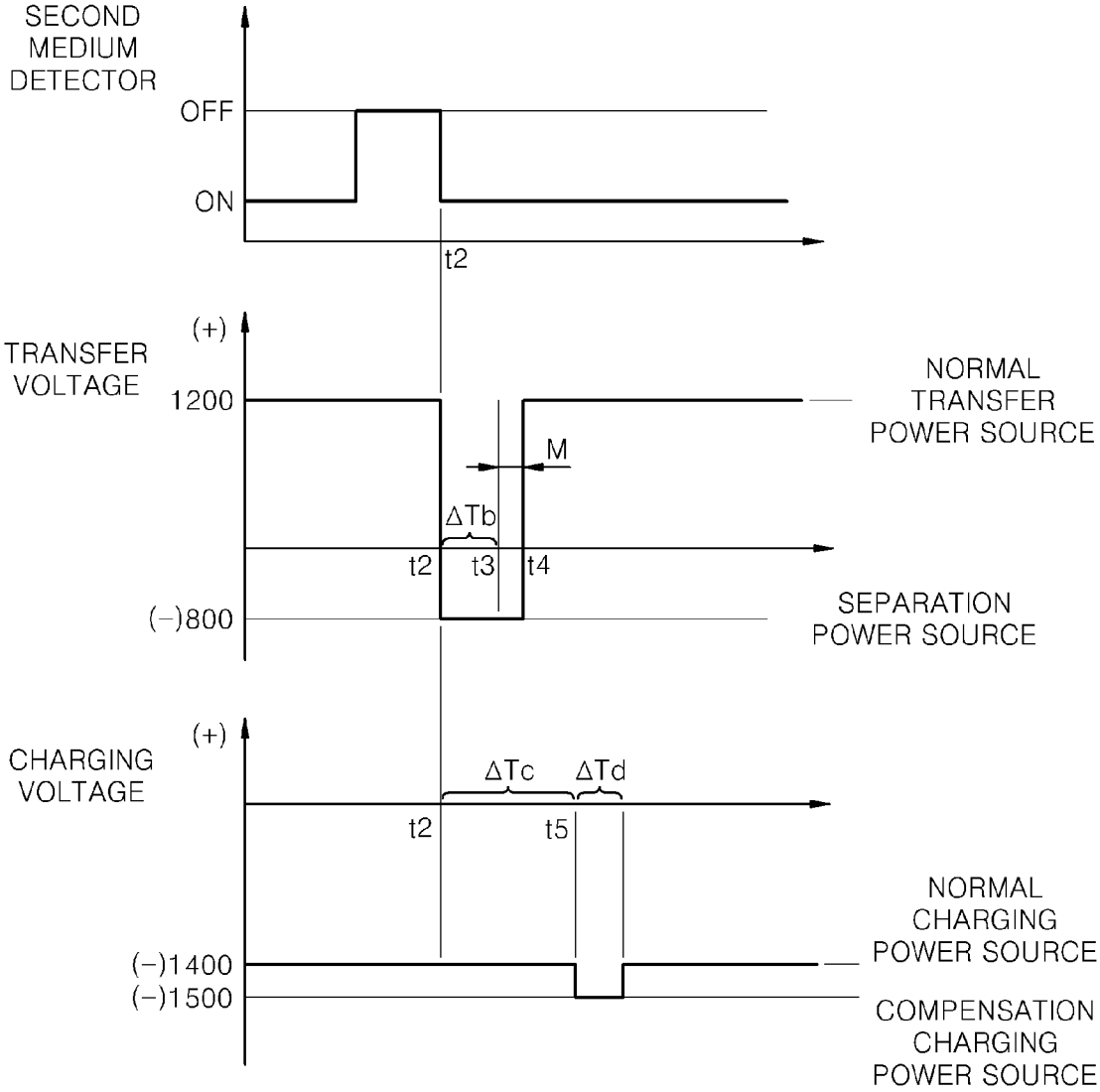
FIG. 5 illustrate graphs of a signal of a second medium detector, a transfer voltage, and a charging voltage of the image forming apparatus in FIG. 4 according to time elapsed.

As illustrated in FIG. 5, a reaching time t2 at which the rear non-printing section X of the printing medium P1 reaches the transfer region A may be determined by a detection signal of the second medium detector 170*a*. In this exemplary embodiment, the reaching time t2 may be counted more accurately by the second medium detector 170*a*, after it is detected by a sensor.

A separation time t3 and a charging time t5 may be counted by the Formula 3 to the Formula 5 in a similar method as that according to the exemplary embodiment of the present general inventive concept describe above.

Figure 6:
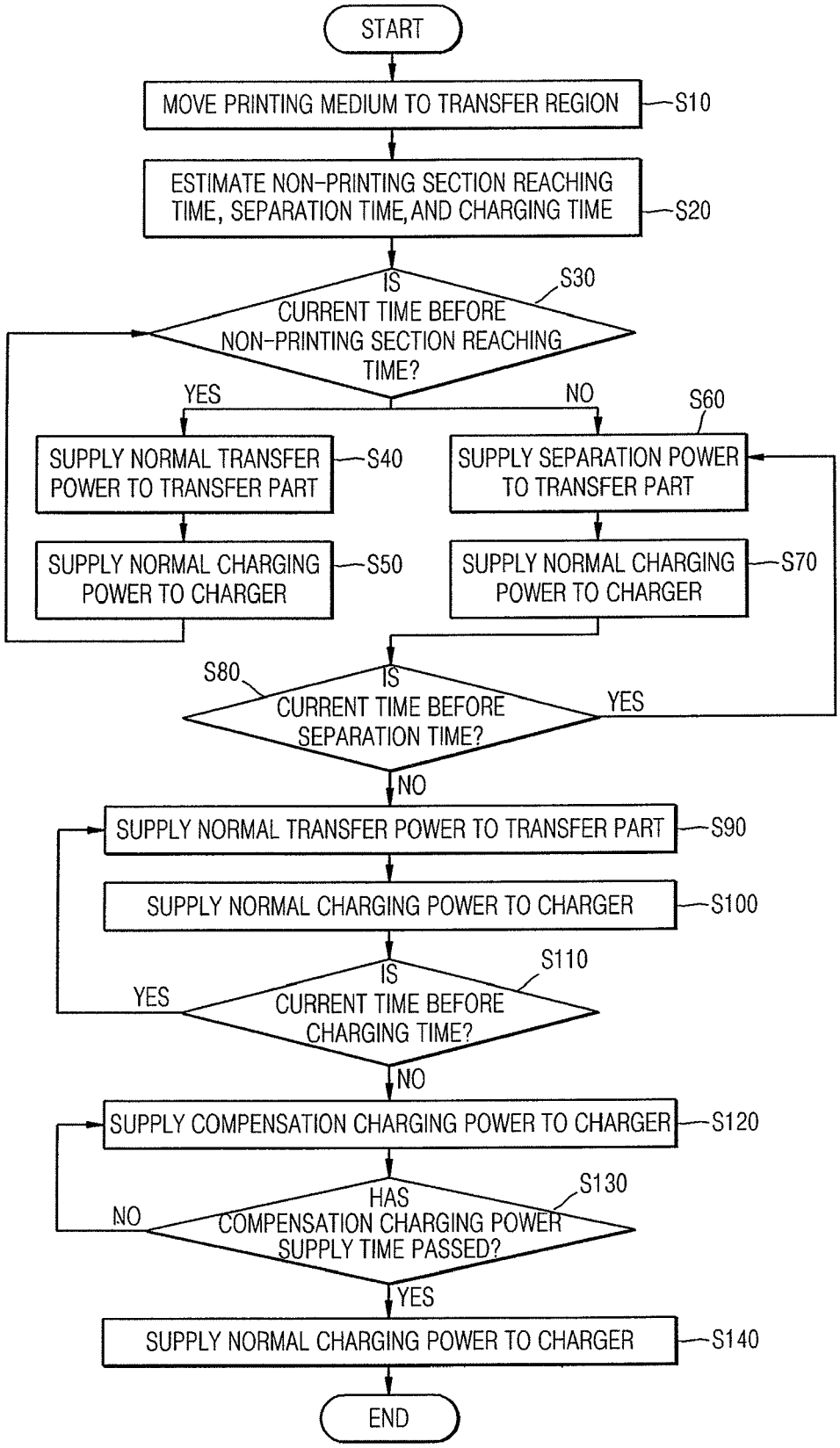
FIG. 6 is a flowchart of an image forming method according to an embodiment of the present general inventive concept.

Hereinafter, an image forming method of the image forming apparatus 100 according to the present general inventive concept will be described with reference to FIG. 6.

The printing medium P1 is moved to the transfer region A formed between the photosensitive body 140 and the transfer part 150 (refer to FIG. 2A) in operation S10. When the first medium detector 170 detects the sensor passing time t1 at which the printing medium P1 passes the first medium detector 170, the charging time counter 193 and the reaching time estimator 195 count the non-printing section reaching time t2, the separation time t3, and the charging time t5 (S20) from the first sensor passing time t1. Some of the non-printing section reaching time t2, the separation time t3 and the charging time t5 may be counted as needed. The estimation method is the same as that in the image forming apparatus 100 according to the exemplary embodiment of the present general inventive concept described above. Thus, the detailed description will be avoided here.

If the time ΔTa between the non-printing section reaching time t2 and the sensor passing time t1, the time ΔTc between the charging time t5 and the non-printing section reaching time t2, and the time ΔTb between the separation time t3 and the non-printing section reaching time t2 are stored in the memory (refer to Formulas 1, 2 and 3), the non-printing section reaching time t2, the separation time t3 and the charging time t5 may be directly calculated by using the stored time ΔTa, ΔTc and ΔTb.

Then, the controller 190 determines whether the current time is before the non-printing section reaching time t2 in operation S30. If the current time is before the non-printing section reaching time t2, the controller 190 controls the power supply 180 to supply the normal transfer power and the normal charging power to the transfer part 150 and the charger 130, in operations S40 and S50, respectively. Then, the printing section Y of the printing medium P1 is printed normally (refer to FIG. 2A).

If the current time is the reaching time or after the reaching time, the controller 190 controls the power supply 180 to supply the separation power and the normal charging power to the transfer part 150 and the charger 130, in operations S60 and S70, respectively.

Then, the controller 190 determines whether the current time is before the separation time t3 in operation S80. If the current time is before the separation time t3, the controller 190 controls the power supply 180 to keep supplying the separation power and the normal charging power to the transfer part 150 and the charger 130 in operations S60 and S70. Meanwhile, the switching time t4 which is obtained with the predetermined margin time M added to separation time t3 may be used.

If the current time is the separation time t3 or after the separation time t3, the controller 190 controls the power supply 180 to supply the normal transfer power to the transfer part 150, and the normal charging power to the charger 130 in operation S100.

Then, the controller 190 determines whether the current time is before the charging time t5 in operation S110. If the current time is before the charging time t5, the controller 190 controls the power supply 180 to keep supplying the normal transfer power to the transfer part 150 and the normal charging power to the charger 130 in operations S90 and S100.

If the current time is the charging time t5 or after the charging time t5, the controller 190 controls the power supply 180 to supply the compensation charging power to the charger 130 in operation S120.

Then, the controller 190 determines whether the predetermined compensation charging power supplying time has passed since the charging time t5, and controls the power supply 180 to keep supplying the compensation charging power to the charger 130 until the compensation charging power supplying time in operation S130 passes.

If the compensation charging power supplying time passes, the controller 190 controls the power supply 180 to supply the normal charging power to the charger 130 in operation S140.

Then, the positive charge of the transfer part 150 may be minimally introduced to the photosensitive body 140 through the printing medium P1. When the charger 130 charges the rear end contact surface E of the photosensitive body 140 contacting the rear end Pa of the printing medium P1, the compensation charging power is supplied to the charger 130. Then, the electric potential of the rear end contact surface E is compensated to be restored to the normal surface potential of the photosensitive body 140. Thus, a line does not appear on the subsequent printing medium, thereby improving the printing quality.

The image forming apparatus and the image forming method thereof according to the present general inventive concept have following effects.

First, a surface potential of a photosensitive body which is lost by an introduction of electric charge while charging the surface of the photosensitive body is compensated, thereby improving printing quality.

Second, when a rear non-printing section of the printing medium enters a transfer region, a transfer part receives separation power, thereby reducing the amount of an electric charge supplied to the photosensitive body when the printing medium is separated from the photosensitive body.

Third, a controller may be less overloaded by adjusting a position of a printing medium detector, according to the second exemplary embodiment of the present general inventive concept.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

a photosensitive body to be developed by a toner;

a charger which charges a surface of the photosensitive body with a surface potential;

a power supply which supplies one of a normal charging power to perform a normal charging operation and a compensation charging power having a different absolute value than the normal charging power and having the same polarity as the normal charging power, to the charger;

a transfer part which faces the photosensitive body, with the printing medium to be printed being interposed therebetween;

a medium moving part which moves the printing medium to a transfer region formed between the photosensitive body and the transfer part; and a controller which controls the power supply to supply the normal charging power to the charger before and after a charging time at which a rear end contact surface of the photosensitive body contacting a rear end of a printing medium is charged by the charger, and to supply the compensation charging power to the charger during charging time, wherein the compensation charging power has a larger absolute value than the normal charging power, the power supply supplies one of a normal transfer power to form a printing potential difference to the photosensitive body and perform a normal printing operation, and a separation power to form a potential difference lower than the printing potential difference to the transfer part, and the controller controls the power supply to supply the normal transfer power and the separation power to the transfer part, respectively, before and after a non-printing section reaching time at which the rear non-printing section of the printing medium reaches the transfer region, and a polarity of the normal transfer power is opposite to that of the separation power.

2. The image forming apparatus according to claim 1, further comprising:

a charging time counter which counts the charging time.

3. The image forming apparatus according to claim 2, further comprising:

a medium moving part which moves the printing medium to the photosensitive body; and a first medium detector provided on a printing medium moving path before the printing medium passes the photosensitive body to detect a position of the printing medium, wherein the charging time counter calculates the charging time based on a detection signal of the first medium detector and a moving speed of the printing medium.

4. The image forming apparatus according to claim 1, further comprising:

a reaching time estimator which counts the non-printing section reaching time.

5. The image forming apparatus according to claim 4, further comprising:

a first medium detector provided on a printing medium moving path before the printing medium passes the transfer region to detect a position of the printing medium, wherein the reaching time estimator calculates the non-printing section reaching time based on a detection signal of the first medium detector and a moving speed of the printing medium.

6. The image forming apparatus according to claim 4, wherein the reaching time estimator counts a separation time at which the rear non-printing section of the printing medium is separated from the transfer region.

7. The image forming apparatus according to claim 4, wherein the controller controls the power supply to supply the separation power to the transfer part from the non-printing section reaching time to the separation time, and to supply the normal transfer power to the transfer part before the non-printing section reaching time and after the separation time.

8. The image forming apparatus according to claim 1, further comprising:

a second medium detector which is spaced from the transfer region as much as the rear non-printing section of the printing medium on the printing medium moving path before the printing medium passes the transfer region and detects a position of the printing medium, wherein the controller controls the power supply to supply one of the normal transfer power and the separation power to the transfer part according to the detection signal of the second medium detector.

9. The image forming apparatus according to claim 1, wherein the separation power corresponds to the surface potential.

10. An image forming method of an image forming apparatus which comprises a photosensitive body to be developed by a conductive toner, a charger charging a surface of the photosensitive body in a surface potential, and a transfer part facing the photosensitive body, with a printing medium to be printed being interposed therebetween, the method comprising:

moving the printing medium to a transfer region;

determining whether a current time is before or after a charging time at which a rear end contact surface of the photosensitive body contacting a rear end of the printing medium is charged by the charger;

supplying a normal charging power to the charger to perform a normal charging operation if the current time is before the charging time;

supplying a compensation charging power having a different absolute value than the normal charging power and having the same polarity as the normal charging power, to the charger if the current time is after the charging time;

determining whether the current time is before or after a non-printing section reaching time at which the rear non-printing section of the printing medium reaches the transfer region;

supplying a normal transfer power to the transfer part to form a printing potential difference to the photosensitive body and perform a normal printing operation if the current time is before the non-printing section reaching time; and supplying a separation power to the transfer part to form a potential difference lower than the printing potential difference if the current time is after the non-printing section reaching time, wherein the compensation charging power has a larger absolute value than the normal charging power, and a polarity of the normal transfer power is opposite to that of the separation power.

11. The method according to claim 10, further comprising: estimating the charging time.

12. The method according to claim 11, wherein the image forming apparatus further comprises:

a first medium detector provided on a printing medium moving path before the printing medium passes the transfer region to detect a position of the printing medium, wherein the estimating the charging time comprises calculating the charging time based on a detection signal of the first medium detector and a moving speed of the printing medium.

13. The method according to claim 10, further comprising: supplying the normal charging power to the charger after a time passes from the charging time.

14. The method according to claim 10, further comprising: estimating the non-printing section reaching time.

15. The method according to claim 14, wherein the image forming apparatus further comprises:

a first medium detector provided on a printing medium moving path before the printing medium passes the transfer region to detect a position of the printing medium; and wherein the non-printing section reaching time is calculated based on a detection signal of the first medium detector and a moving speed of the printing medium.

16. The method according to claim 15, further comprising:

estimating separation time at which the rear non-printing section of the printing medium is separated from the transfer region; and supplying the separation power to the transfer part until the separation time.

17. The method according to claim 16, further comprising: supplying the normal transfer power to the transfer part after the separation time passes.

* * * * *